US006663361B2

(12) United States Patent
Kohl et al.

(10) Patent No.: US 6,663,361 B2
(45) Date of Patent: Dec. 16, 2003

(54) SUBSEA CHEMICAL INJECTION PUMP

(75) Inventors: Kristopher T. Kohl, Houston, TX (US); Charles Mitchell Means, Richmond, TX (US)

(73) Assignee: Baker Hughes Incorporated, Houston, TX (US)

( * ) Notice: Subject to any disclaimer, the term of this patent is extended or adjusted under 35 U.S.C. 154(b) by 276 days.

(21) Appl. No.: 09/811,069

(22) Filed: Mar. 16, 2001

(65) Prior Publication Data

US 2002/0004014 A1 Jan. 10, 2002

(Under 37 CFR 1.47)

Related U.S. Application Data

(60) Provisional application No. 60/194,433, filed on Apr. 4, 2000.

(51) Int. Cl.[7] ..... F04B 17/04; F04B 39/10; F01B 31/10; H02K 41/00; H02K 33/00

(52) U.S. Cl. ..... 417/417; 417/418; 417/534; 92/153; 92/310; 92/14; 92/15

(58) Field of Search ..... 417/416, 417, 417/418, 534, 538; 184/6.8, 6.17; 92/153; 310/12, 13, 14, 15–35

(56) References Cited

U.S. PATENT DOCUMENTS

| | | | | | |
|---|---|---|---|---|---|
| 1,766,829 | A | * | 6/1930 | Myers | 92/153 |
| 3,196,797 | A | * | 7/1965 | Marini | 417/418 |
| 3,418,942 | A | * | 12/1968 | Partos | 92/71 |
| 3,931,554 | A | * | 1/1976 | Spentzas | 318/122 |
| 4,090,430 | A | * | 5/1978 | Matsumoto et al. | 92/71 |
| 5,062,770 | A | * | 11/1991 | Story et al. | 417/46 |
| 5,106,274 | A | | 4/1992 | Holtzapple | |
| 5,348,451 | A | * | 9/1994 | Mohn | 417/390 |
| 5,713,728 | A | | 2/1998 | Salamey | |
| 5,779,455 | A | * | 7/1998 | Steiger | 417/418 |
| 5,879,145 | A | * | 3/1999 | Baumgartner | 417/524 |

FOREIGN PATENT DOCUMENTS

| | | | | |
|---|---|---|---|---|
| DE | 2903817 A1 | | 8/1980 | |
| DE | 19707654 A1 | | 8/1998 | |
| EP | 0237145 A2 | | 9/1987 | |
| EP | 0310254 A2 | | 4/1989 | |
| EP | 0 332 378 | * | 9/1989 | F04B/17/04 |
| EP | 0373766 A2 | | 6/1990 | |
| GB | 691016 | | 5/1953 | |
| JP | 55-17677 | * | 2/1980 | F04B/17/04 |
| WO | WO 96/34195 A1 | | 10/1996 | |

OTHER PUBLICATIONS

PCT International Search Report for International Application No. PCT/US01/09006, Aug. 21, 2001.

* cited by examiner

*Primary Examiner*—Charles G. Freay
*Assistant Examiner*—Timothy P. Solak
(74) *Attorney, Agent, or Firm*—Madan, Mossman & Sriram, P.C.

(57) ABSTRACT

A chemical injection pump for injecting chemicals into subsea system at depths up to 10,000 feet is described which uses a minimum of moving parts by employing an actuator, for instance a solenoid, to power a double acting actuator rod and plungers thereon. The pump would generate low pressures and low fluid volumes, but be more durable and reliable than conventional rotating pumps operating under subsea conditions.

15 Claims, 1 Drawing Sheet

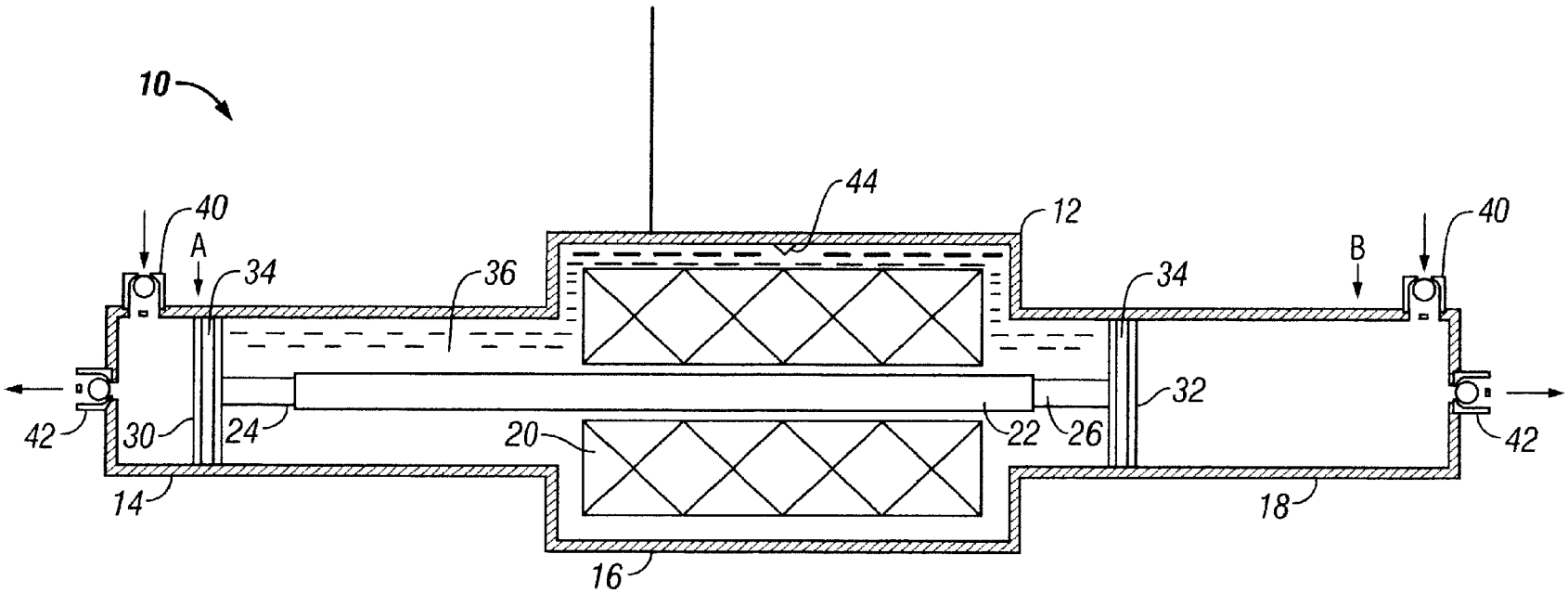
10
40
A
34
36
44
12
40
B
34
32
26
22
24
20
30
42
42
14
16
18

SUBSEA CHEMICAL INJECTION PUMP

CROSS-REFERENCE TO RELATED APPLICATION

This application claims the benefit of U.S. Provisional Application No. 60/194,433 filed Apr. 4, 2000.

FIELD OF THE INVENTION

The instant invention relates to relatively low volume chemical injection pumps, and more particularly relates, in one embodiment, to low volume chemical injection pumps for use in subsea applications.

BACKGROUND OF THE INVENTION

In the art and science of recovering hydrocarbons from reservoirs beneath water, such as through off shore drilling platforms and other subsea operations, it is necessary to inject treatment chemicals into the well or wellbore, the drilling fluid therein, or in hydrocarbon transmission pipelines, etc. Such treatment chemicals may include, but are not necessarily limited to, corrosion inhibitors, scale inhibitors, paraffin inhibitors, hydrate inhibitors, demulsifiers, and the like, and mixtures thereof.

The injection of treatment chemicals into these systems requires generally only low flow rates. When delivering low flow rates using positive displacement-type pumps in an atmospheric system, net positive suction head (NPSH) is often a problem. A good design for a subsea pump should try to inherently eliminate NPSH problems. Further, a major problem with positive displacement pumps, especially at high pressure, is that the check valve seats and piston/plunger packing can be inherently leaky, and cause fluid to leak through the pump, back to the suction side or back into the suction piping. Another problem with small volume, positive displacement diaphragm or plunger pumps is that they can vapor or air lock very easily. Small bubbles in the pump chamber can expand and contract with plunger movement and cavitate and stall the pump.

Further, because the location of such chemical injection pumps is by definition at the bottom of the ocean or sea, they are subjected to severe conditions and are difficult to service due to their remote location. Thus, subsea chemical injection pumps should be strong, durable, and if possible, reparable at a distance.

SUMMARY OF THE INVENTION

An object of the present invention is to provide a method and apparatus for injecting chemical into a system that is underwater or subsea.

Another object of the present invention is to provide a subsea chemical injection pump that has a minimum of moving parts.

It is yet another object of the invention is to provide a subsea chemical injection pump which can be repaired from a remote distance and/or which may continue to operate if partially disabled.

In carrying out these and other objects of the invention, there is provided, in one form, a subsea chemical injection pump having a housing comprising opposing chambers, one on either side of a central enclosure. Each chamber has parallel walls and a cross section, and the opposing chambers extend from the central enclosure on opposite sides thereof. That is, opposing chambers are lined up across the central enclosure, although the opposing chambers are not necessarily coaxial with one another. There is present in the central enclosure at least one actuator (e.g. solenoid coil), where the actuator drives an actuator rod. The actuator rod has two ends, one each extending into an opposing chamber, and a first and second plunger, one on each end of the actuator rod, where first plunger has a circumference adapted to fill and mate with the cross section of its chamber, and where second plunger has a circumference adapted to fill and mate with the cross section of its chamber. The actuator rod and plungers on either end move back and forth between maximum travel points in the opposing chambers under the influence of the actuator, alternately decreasing and increasing the volumes of the opposing chambers, respectively. A seal is preferably present on the circumference of each plunger to inhibit fluid from entering the central enclosure from the opposing chambers. An inert coolant and lubrication fluid is present in the central enclosure between the plungers. Finally, each opposing chamber contains a suction check valve and a discharge check valve therein, in a region beyond the maximum travel point of the plunger.

BRIEF DESCRIPTION OF THE DRAWING

The FIGURE is a schematic, cross-sectional illustration of a subsea chemical injection pump of this invention, in one embodiment. It will be appreciated that the FIGURE is not to scale and that many features are not shown in actual or optimum proportion so that the invention may be clearly illustrated. For instance, the plungers may actually be thinner relative to the actuator rod from what is shown.

DETAILED DESCRIPTION OF THE INVENTION

It has been discovered that a double-acting solenoid pump, in one non-limiting embodiment, meets many, if not all of the requirements of a subsea chemical injection pump. Such a pump would be relatively low volume, for example delivering from about 2 to about 250 gallons per day, and produce high pressures, unique to this design up to 15,000 psi differential pressure.

The subsea chemical injection pump of this invention is schematically shown in the Figure generally at 10, which has a housing 12 of three main sections, opposing chambers, first chamber 14 and a second chamber 18 on either side of a central enclosure 16. Opposing chambers 14 and 18 each have parallel walls and a cross-section. Parallel walls are defined as walls a plunger of constant circumference and shape can travel along while the plunger circumference is in constant contact with the walls. In one preferred embodiment of the invention, opposing chambers 14 and 18 are cylinders and their cross-sections are circles, for ease of manufacture, but this is not a requirement. Indeed, in one preferred, but non-limiting embodiment, entire housing 12 generally, and central enclosure 16 may also be cylinders. In the case where opposing chambers 14 and 18 are cylinders, it can be appreciated that the parallel walls are a continuous, curved wall. While it is expected that opposing chambers 14 and 18 would be of equal volumes in most instances, this is not required. Furthermore, while opposing chambers 14 and 18 extend from the central enclosure 16 on opposite sides thereof, it will be appreciated that the chambers 14 and 18 may not be exactly 180° apart, but could be at a lesser angle with respect to each other. Further, it is anticipated that in some embodiments, there may be more than two opposing chambers 14 and 18.

Central enclosure 16 contains at least one actuator 20 that is connected to and/or drives an actuator rod 22. In one non-limiting embodiment of the invention the actuator 20 is a solenoid surrounding actuator rod 22. Other suitable devices for driving the actuator rod 22 may be used. Actuator rod 22 is oriented in the same direction as opposing chambers 14 and 18, and the actuator rod 22 has two opposite ends, first end 24 and second end 26.

In a preferred embodiment, opposing chambers 14 and 18 have the same direction in the sense that they are generally aligned with each other, but they are not necessarily coaxial. That is, the chambers 14 and 18 are aligned such that actuator rod 22 within solenoid coil 20 is parallel to, but not necessarily coaxial with the chambers. In one preferred embodiment, actuator rod 22 is straight. In another preferred embodiment of the invention, opposing chambers 14 and 18 may actually be coaxial with actuator rod 16 and each other. Alternatively, there could be two actuator rods 20 which could be in line with each other (at a 180° angle) or at an angle less than 180° as long as opposing chambers were at the same angle. One rod 22 would then bear first plunger 30 and the other rod 22 would bear second plunger 32.

Actuator rod 22 has a first plunger 30 and second plunger 32, on the first end 24 and second end 26, respectively, thereof. First plunger 30 has a circumference adapted to fill and mate with the cross-section of its chamber, here first chamber 14. Since plunger 30 is seen edge-on in the Figure the entire circumference is not seen. However, if first opposing chamber 14 is a cylinder with a circular cross-section, the circumference of first plunger 30 would be circular in shape. Similarly, second plunger 32 has a circumference adapted to fill and mate with the cross-section of its chamber, here second chamber 18. Actuator rod 22 and plungers 30 and 32 on either end move back and forth between maximum travel point A in chamber 14 and maximum travel point B in chamber 18 under the influence of actuator or solenoid coil 20. This action alternately decreases and increases the working volumes of the opposing chambers 14 and 18. That is, the volume of opposing chamber 14 which may contain treating chemical is decreased the same amount that the volume of opposing chamber 18 which also may contain the same or different treating chemical is increased, respectively, and vice versa.

There should be at least one seal 34 present on the circumference of each plunger 30 and 32 to inhibit fluid, such as the treatment chemical from entering the central enclosure 16 from the opposing chambers 14 and 18. Tolerances of seals 34 with respect to the cross-sections of the chambers 14 and 18 should be sufficiently tight to accomplish the sealing function, but not so tight as to undesirably interfere with the movement of plungers 30 and 32, respectively. Within central enclosure 16 and between the plungers 30 and 32, and surrounding the solenoid coil 20 and actuator rod 22 there is present an inert coolant and lubrication fluid 36.

In a preferred embodiment, the central solenoid enclosure 16 is pressurized with inert, lubricating fluid 36 that serves several purposes, including, but not necessarily limited to, 1) lubricating the actuator rod 22 and piston seals 34; 2) providing resistance or "damping" of the actuator rod 22 movement (slightly slowing down actuator rod 22 so that it does not snap or slam back and forth); and 3) allowing the pump 10 to be pressurized at the surface, so that pressure equalizes as it descends to the sea floor for placement. These multiple functions are anticipated to increase pump life under expected heavy loading. In another non-limiting embodiment of the invention, the pump 10 may be pressurized such that equalization occurs approximately half-way to the bottom so that the design thicknesses of the housing 12 only needs to be half that of the pressure the pump 10 will be subjected to at the total water depth. This will keep a positive pressure in the central enclosure 16 and help prevent chemical or sea water from penetrating the central enclosure 16.

Each opposing chamber 14 and 18 is provided with at least one "one-way" suction check valve 40 and one "one-way" discharge check valve 42. These valves 40 and 42 may be of any conventional design or future design which permits fluid to enter chambers 14 and 18 and be discharged therefrom, respectively, in one direction. Valves 40 and 42 must be positioned within their respective chambers at points beyond the maximum travel points (A and B) of the plunger to avoid leaking of the fluid into the central enclosure 16.

Check valves 40 and 42 could be integral to the housing 12, but in a preferred embodiment they would be independent, discrete parts assembled into the pump housing 12. In another non-limiting embodiment of the invention, the pump 10 design may incorporate a plurality of suction check valves 40 arranged sequentially in a magazine (not shown) so that the valves 40 may be remotely replaced. In one embodiment, the check valve magazines are operated remotely in a sequential or serial fashion to replace non-functioning valves. Such a design that permits changing the valve and seat without having to retrieve the pump 10 if a check valve were to fail would be advantageous. The same could be true of the discharge check valves 42.

Central enclosure 16 may be provided with a leak detector 44 in the interior thereof to determine if any fluid from the opposing chambers 14 and 18 has leaked into the central enclosure 16 and inert coolant and lubrication fluid 36. Leak detector 44 may be a pressure switch or conductivity probe or other device on the inert fluid side 16 to detect a leak past the dynamic piston seals 34. Leak detector 44 need not be located in the center of central enclosure 16 as shown in the Figure. For instance, there may be one leak detector 44 on either end of the interior of the central enclosure 16 near to where actuator rod 22 exits solenoid 20.

The subsea chemical injection pump 10 is designed to be electrically actuated via a double-acting solenoid, or two separate, single-acting solenoids, in different, non-limiting embodiments. By "double-acting", it is meant that the solenoid is of the type that can move the actuator rod 22 alternately in either direction; "single-acting" refers to a solenoid that would move the actuator rod 22 in only one direction; it would have to be paired with a second single-acting solenoid with reverse polarity to move actuator rod 22 back in the other direction. It is expected that the use of one or more solenoids will make the pump 10 precisely controllable.

The pump 10 is intended to sit on the sea floor (up to 10,000 ft of water depth) adjacent to the subsea tree or manifold. The pump 10 may be controlled by alternating current polarity in order to change direction of the plungers 30 and 32, in one non-limiting embodiment. Alternatively, if two different solenoids are employed, the pump may be controlled by current to the two solenoids alternately.

Power would be provided by the subsea manifold. Controlling and monitoring of the pump may be conducted via RS-485 communications through a fiber optic line that provides telemetry to and from the subsea manifold, in one embodiment. Monitoring could include, but not necessarily be limited to, determination of pump function such as speed or force, whether the pump is leaking in any chamber or enclosure, whether the valves are operating properly, etc.

Control may include, but not necessarily be limited to, controlling pump operation and speed, causing replacement of faulty valves, switching from one chamber to another, performing repair operations, etc. Control operations could be performed manually or automatically in response to the outcome of monitoring.

In one embodiment of the invention, the inert coolant and lubrication fluid 36 is selected from fluids including, but not limited to, silicone-based fluids, generally available hydrocarbon-based lubricating fluids, and the like and may have a viscosity between about 10 and about 50 cP. The construction materials must, of course, be strong and durable to withstand the pressures, brines and other conditions of the harsh environment in which they are expected to operate.

A purpose of the solenoid design of the pump 10 of the invention is to minimize the number of moving parts and thus eliminate failure modes associated with rotating equipment, such as is the design of many conventional pumps. Workovers on subsea equipment such as this are tremendously expensive, and minimizing economic loss is of primary concern. Thus, it is preferred to reduce complexity, be able to tightly control pump operation and build in redundancy, where possible.

A further advantage of the subsea chemical injection pump of this invention is that flow is relatively continuous. That is, one side can be always discharging into the system. Further, the pump in one sense can be understood to be "sealless", in that a plunger seal leak will only diffuse into the central inert fluid enclosure and not into the environment.

The subsea chemical injection pump of this invention would be located adjacent a chemical storage tank on the sea floor, or within the storage tank itself. In one embodiment of the invention, the tank, bladder system and pump could be one integral unit. In a preferred embodiment, the subsea chemical injection pump is integral to coiled tubing or could be retrievable via wireline from the tank.

In the foregoing specification, the invention has been described with reference to specific embodiments thereof. However, it will be evident that various modifications and changes can be made thereto without departing from the broader spirit or scope of the invention as set forth in the appended claims. Accordingly, the specification is to be regarded in an illustrative rather than a restrictive sense. For example, specific proportions, materials, features and operating ranges, falling within the claimed parameters, but not specifically identified or tried in a particular subsea injection pump or in the operation of such a pump, are anticipated to be within the scope of this invention.

We claim:

1. A subsea chemical injection pump comprising:

a) a housing comprising opposing chambers, one on either side of a central enclosure, where each chamber has parallel walls and a cross section and where opposing chambers extend from the central enclosure on opposite sides thereof;

b) at least one actuator in the central enclosure, said actuator driving c) an actuator rod having two ends, one each extending into an opposing chamber;

d) a first and second plunger, one on each end of the actuator rod, where first plunger has a circumference adapted to fill and mate with the cross section of its chamber, and where second plunger has a circumference adapted to fill and mate with the cross section of its chamber, such that actuator rod and plungers on either end move back and forth between maximum travel points in the opposing chambers under the influence of the actuator, alternately decreasing and increasing the volumes of the opposing chambers;

e) a seal on the circumference of each plunger to inhibit pumped fluid from entering the central enclosure from the opposing chambers;

f) an inert coolant and lubrication fluid filling the central enclosure between the plungers surrounding said actuator rod;

g) a suction check valve and a discharge check valve in each opposing chamber beyond the maximum travel point of the plunger; and h) communications connections to a subsea manifold for monitoring and controlling the pump.

2. The subsea chemical injection pump of claim 1 wherein the actuator is a at least one solenoid coil.

3. The subsea chemical injection pump of claim 2 wherein the at least one solenoid coil comprises one double acting solenoid coil.

4. The subsea chemical injection pump of claim 2 wherein the at least one solenoid coil comprises two single acting solenoid coils.

5. The subsea chemical injection pump of claim 1 where the central enclosure is pressurized.

6. The subsea chemical injection pump of claim 1 where the central enclosure comprises at least one leak detector.

7. The subsea chemical injection pump of claim 1 where the opposing chambers are cylindrical with a circular cross-section and the plungers have a circular perimeter to match the circular cross-section.

8. A method of injecting chemical into a system at an underwater location comprising:

a) providing a subsea chemical injection pump comprising:

i) a housing having opposing chambers, one on either side of a central enclosure, where each chamber has parallel walls and a cross section and where opposing chambers extend from the central enclosure on opposite sides thereof;

ii) at least one actuator in the central enclosure, said actuator driving iii) an actuator rod having two ends, one each extending into an opposing chamber;

iv) a first and second plunger, one on each end of the actuator rod, where first plunger has a circumference adapted to fill and mate with the cross section of its chamber, and where second plunger has a circumference adapted to fill and mate with the cross section of its chamber, such that actuator rod and plungers on either end move back and forth between maximum travel points in the opposing chambers under the influence of the actuator, alternately decreasing and increasing the volumes of the opposing chambers;

v) a seal on the circumference of each plunger to inhibit pumped fluid from entering the central enclosure from the opposing chambers;

vi) an inert coolant and lubrication fluid filling the central enclosure between the plungers surrounding said actuator rod; and vii) a suction check valve and a discharge check valve in each opposing chamber beyond the maximum travel point of the plunger;

b) connecting the actuator to a power source;

c) connecting at least one of the suction check valves to a chemical source;

d) connecting at least one of the discharge check valves to a system; and e) operating the pump to inject chemical into the system.

9. The method of claim 8 where in providing the subsea chemical injection pump, the actuator is a at least one solenoid coil.

10. The method of claim 9 where in providing the subsea chemical injection pump, the at least one solenoid coil comprises one double acting solenoid coil.

11. The method of claim 9 where in providing the subsea chemical injection pump, the at least one solenoid coil comprises two single acting solenoid coils.

12. The method of claim 8 where in providing the subsea chemical injection pump, the central enclosure is pressurized.

13. The method of claim 8 where in providing the subsea chemical injection pump, the central enclosure comprises at least one leak detector.

14. The method of claim 8 where in providing the subsea chemical injection pump, the opposing chambers are cylindrical with a circular cross-section and the plungers have a circular perimeter to match the circular cross-section.

15. The method of claim 8 further comprising monitoring and controlling the pump.

* * * * *